United States Patent [19]

Tsuda et al.

[11] 4,271,571

[45] Jun. 9, 1981

[54] PROCESS FOR MANUFACTURING SHADOW MASK OF BRAUN TUBE FOR COLOR TV

[75] Inventors: Takeshi Tsuda, Takatsuki; Michio Kubota, Amagasaki; Kazuhiro Takagi, Amagasaki; Masahiro Shimose, Amagasaki; Yasuo Imamura, Urawa; Kazunori Kato, Tokyo, all of Japan

[73] Assignees: Nisshin Steel Co., Ltd.; Dai Nippon Printing Co. Ltd., both of Tokyo, Japan

[21] Appl. No.: 83,635

[22] Filed: Oct. 11, 1979

[30] Foreign Application Priority Data

Oct. 18, 1978 [JP] Japan ..... 53-128031

[51] Int. Cl.[3] ..... H01J 9/02

[52] U.S. Cl. ..... 29/25.18

[58] Field of Search ..... 29/25.17, 25.18

[56] References Cited

U.S. PATENT DOCUMENTS

| | | | |
|---|---|---|---|
| 3,693,223 | 9/1972 | Kaplan | 29/25.18 X |
| 4,210,843 | 7/1980 | Avadani | 29/25.18 X |

*Primary Examiner*—Richard B. Lazarus

*Attorney, Agent, or Firm*—Kane, Dalsimer, Kane, Sullivan and Kurucz

[57] ABSTRACT

In process for manufacturing shadow mask of Braun tube for color TV comprising steps of subjecting strip of low carbon steel to cold rolling finish, forming holes in the rolled material, cutting it into individual flat masks, annealing each mask at elevated temperatures, conditioning the annealed mask and press-forming the mask into desired shape, the improvement residing in controlling the finish cold rolling reduction within the range between 10 and 35%, whereby the annealing temperature is reduced to 520° to 750° C. The process is applicable to steel strip material containing up to 0.10% by weight of carbon.

3 Claims, 4 Drawing Figures

PROCESS FOR MANUFACTURING SHADOW MASK OF BRAUN TUBE FOR COLOR TV

BACKGROUND OF THE INVENTION

1. Field of the Invention

The present invention relates to a process for manufacturing a shadow mask of a Braun tube for a color TV.

2. Brief Description of the Invention

As is well known a shadow mask is an extremely thin metal strip having a great number of small holes. It is mounted in front of the fluorescent surface of a Braun tube for a color TV and performs an important part in that three electron beams emitted from three electron guns in accordance with signals of the three primary colors are allowed to pass through each hole so that fluorescent dots distributed on the fluorescent surface are caused to luminesce in three separate colors. Such a shadow mask has heretofore been manufactured as follows. A steel maker subjects a strip of low carbon steel to a cold rolling finish with a rolling reduction of at least 40% to provide a strip material of not more than 0.2 mm in thickness, which is delivered in the form of a coil to an etching processer. At the etching processer, the strip material is pretreated to remove oil while being unwound from the coil. Predetermined patterns of holes are then formed in the strip material by application of a photoresist on both sides of the strip, patternwise exposure of the photoresist, developing of the exposed photoresist, hardening of the developed photoresist by burning it at a temperature of about 200° C., etching of the material through the hardened patterned photoresist by spraying an aqueous ferric chloride, and removal of the photoresist. The product is cut into individual flat masks and delivered to a Braun tube maker. At the Braun tube maker, the flat mask having a predetermined pattern of holes is annealed to impart to it a sufficient ductility for the subsequent press-forming. This annealing is normally effected at a high temperature ranging between 750° to 900° C. with the individual masks suspended or stacked. Since the steel strip as annealed has a yield point elongation of several percent "stretcher strains" (Lüders lines) arise when it is press-formed. Furthermore, the flat mask loses its evenness owing to the annealing. In order to erase the unevenness of the annealed strip and to prevent the stretcher strains from arising in the press-forming step, the annealed flat mask is passed several times through a roller leveller, and thereafter press-formed into the desired curved plane. After the formation of oxide films on the surfaces, the shadow mask so manufactured is mounted in a Braun tube.

The prior art process stated above poses several problems, especially regarding the annealing step carried out by a Braun tube maker.

The annealing temperature as high as 750° to 900° C. frequently results in the adhesion of flat masks, leading to the reduction in the yield. Even with successfully annealed flat masks, waves are formed by the annealing at high temperatures and the subsequent leveller rolling to erase such waves involves a danger in that the pattern of holes may be distorted or wrinkles may arise. Furthermore, the high temperature anneal causes the carbon in the low carbon steel material to diffuse and precipitate near the surfaces of the strip, and this precipitation of carbon is not necessarily uniform. Any non-uniformity of the carbon precipitation results in non-uniform elongation of the material in the press-forming step, and thus, faulty products are frequently found after the press-forming step.

To overcome the problems discussed above, attempts have been made to use lower annealing temperatures. However, when a sufficiently low annealing temperature for avoiding the adhesion and thermal distortion of flat masks is used, the grains become finer, resulting in an increase in the yield point elongation of the annealed material, and it is necessary to increase the number of passes through a roller leveller for preventing the stretcher strains from taking place in the subsequent press-forming step. A solution of this problem is proposed in Japanese Patent Examined Publication No. 51-13102, published on Apr. 24, 1976. The proposed solution is based on the use of a steel of an extremely low carbon content of 0.002 to 0.012% by weight. It is taught in this Japanese Patent Publication that if such an extremely low carbon steel is used in the manufacture of a shadow mask the usable annealing temperature can be reduced to the extent of 600° to 750° C. without suffering from the above-mentioned problem, although such low annealing temperatures are unsuitable for a C 0.05% steel normally employed in the manufacture of shadow masks. Incidentally this Publication is completely silent with respect to the rolling reduction in the finish cold rolling step.

SUMMARY OF THE INVENTION

An object of the invention is to provide an improved process for manufacturing a shadow mask of a Braun tube for a color TV, in which lower annealing temperatures may be used without the problem discussed above. In other words, the object of the invention is to provide a different solution to the problem from that given in the above-mentioned Japanese Patent Publication No. 51-13102.

We have found that in the manufacture of a shadow mask, low annealing temperatures ranging from 520° to 750° C. can be successfully used, if the starting low carbon steel strip has been subjected to a cold rolling finish with a specified low rolling reduction of 10 to 35%. The starting steel strip is not necessarily of an extremely low carbon content of not more than 0.012%, as required in the above-mentioned Japanese Patent Publication. The invention is also applicable to steel strip materials containing 0.015 to 0.10% by weight of carbon normally employed in the manufacture of shadow masks.

Thus, in accordance with the invention a process for manufacturing a shadow mask of a Braun tube for a color TV is provided, which process comprises the steps of subjecting a strip of low carbon steel to a cold rolling finish with a rolling reduction of 10 to 35% to provide a steel strip material of not more than 0.2 mm in thickness, forming predetermined patterns of holes in the material by a photoetching technique, cutting the material into individual flat masks of a predetermined dimension, annealing each flat mask at a temperature of 520° to 750° C., conditioning the annealed mask by passing it through a roller leveller, and press-forming the conditioned flat mask into a desired shape.

DETAILED DESCRIPTION OF THE INVENTION

The "grain size number" referred to herein was determined by the Method for Estimating Ferrite Grain Size of Steels in accordance with JIS G0552. Briefly speaking, the grain size number was determined depending upon the observed average number of grains per 25 mm square at a magnification of 100, using the key as shown in Table 1 below.

TABLE 1

| Grain Size Number | Average Number of Grains per 25 mm Square at 100X |
|---|---|
| −3 | 0.0625 |
| −2 | 0.125 |
| −1 | 0.25 |
| 0 | 0.5 |
| 1 | 1 |
| 2 | 2 |
| 3 | 4 |
| 4 | 8 |
| 5 | 16 |
| 6 | 32 |
| 7 | 64 |
| 8 | 128 |
| 9 | 256 |
| 10 | 512 |

Figure 4:
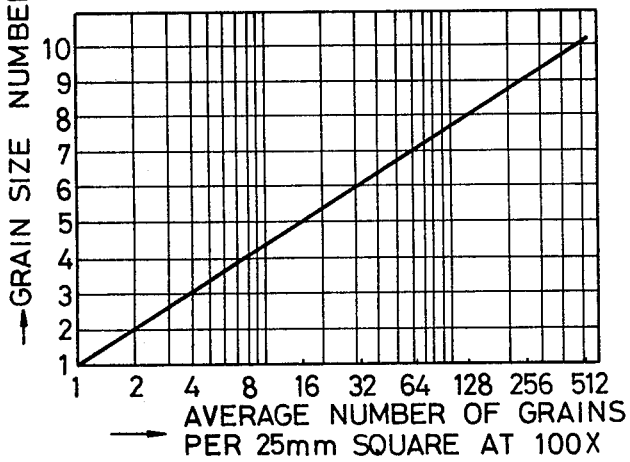
FIG. 4 is a graph for illustrating the grain size number.

This key is graphically shown in FIG. 4, in which the grain size number is plotted against the average number of grains per 25 mm square at a magnification of 100. Obviously, the greater the grain size number, the smaller the grains. For example, a grain size number of 4 means that there are 8 grains on average per 25 mm square at a magnification of 100, whereas a grain size number of 7 means that there are 64 grains on average per 25 mm square at a magnification of 100.

By the "coercive force" of a ferromagnetic material is meant a strength of a magnetic field required to nullify any residual magnetic flux density which has remained after magnetization of the material to saturation by an external field and subsequent removal of such a magnetizing field. When a shadow mask mounted in a Braun tube for a color TV is magnetized, electron beams passing through the holes in the shadow mask are deflected and impact the fluorescent surface at undesired points ("mis-landing"), resulting in color shading or deflection. To prevent such "mis-landing", a Braun tube is equipped with a degaussing circuit to erase the magnetization of the shadow mask. Because the degaussing circuit is very power-consuming, a shadow mask having a low coercive force is desired. Generally, a shadow mask (before or after the press-forming) should preferably have a coercive force of not greater than about 2.0 Oersted when measured with the initial magnetizing field of 25 Oersted.

Figure 1:
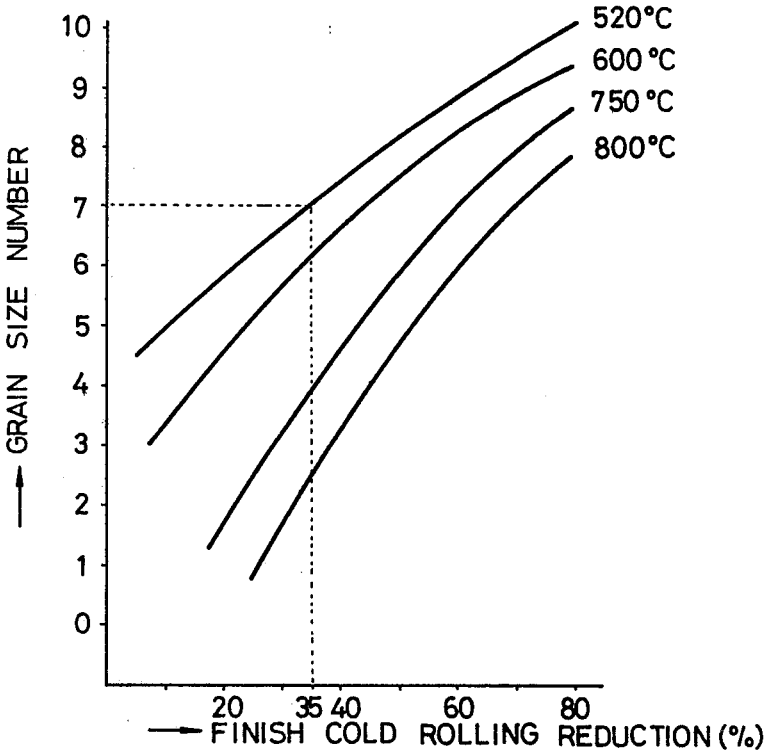
FIG. 1 is a graph illustrating the dependency of the grain size number upon the finish cold rolling reduction and the annealing temperature.

In a series of experiments strips of low-carbon steel containing 0.06% by weight of C were subjected to a cold rolling finish with various rolling reductions to provide strips of 0.15 mm in thickness, which were converted to flat masks by a usual photoetching process. The flat masks were then annealed at various temperatures for 15 minutes. For each annealing temperature tested the grain size number of the products was plotted against the finish rolling reduction. The curves so obtained are shown in FIG. 1. As seen from FIG. 1, a grain size number of 7 can be achieved under the conditions of a rolling reduction of 35%, which is the upper limit of the rolling reduction specified by the invention, and an annealing temperature of 600° C., FIG. 1 further reveals that the smaller the finish cold rolling reduction or the higher the annealing temperature, the grain size number becomes smaller, that is the grains become coarser.

Figure 2:
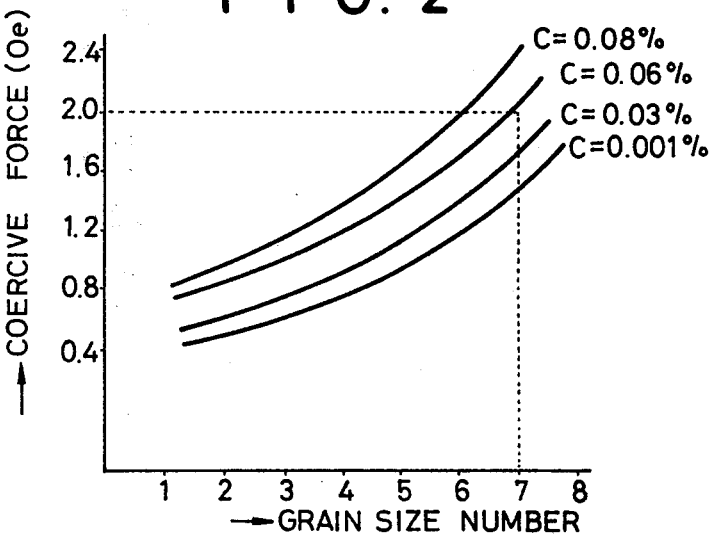
FIG. 2 is a graph illustrating the relation between the coercive force and the grain size number.

In another series of experiments, strips of low carbon steel having various carbon contents were subjected to cold rolling finishes with various rolling reductions of 10 to 35% to provide strips of 0.15 mm in thickness. Flat masks prepared from these strips were annealed at a temperature of 600° C. for 10 minutes. For each carbon content tested the coercive force of the products as measured using the initial magnetizing field of 25 Oersted, was plotted against the grain size number of the products. The curves so obtained are shown in FIG. 2. As seen from FIG. 2, most of the products having a grain size number of 7 or less exhibit the desired low coercive force of not greater than 2.0 Oersted as measured using the initial magnetizing field of 25 Oersted. FIG. 2 further reveals that even with a steel of C 0.08% the desired low level of the coercive force may be achieved by the process conditions of the invention.

Figure 3:
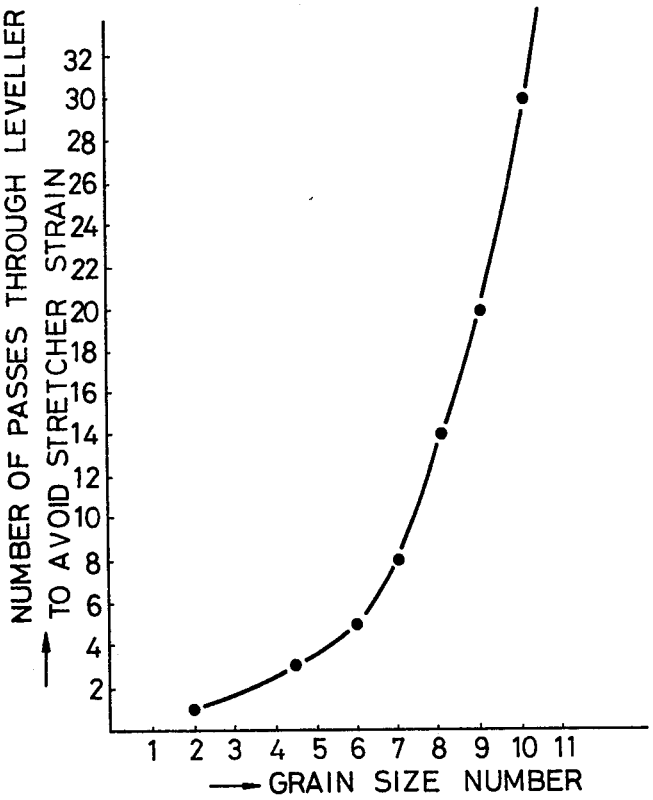
FIG. 3 is a graph showing the relation between the number of passes through a roller leveller required for avoiding "stretcher strains" and the grain size number.

Since a low rolling reduction of not more than 35% is used, the annealed strip material obtained by the process of the invention has coarse grains and exhibits a low yield point elongation. Accordingly, the number of passes through a roller leveller required for avoiding stretcher strains arising in the press-forming step can be small. The relation between the number of passes through a roller leveller required for avoiding stretcher strains arising in the press-forming step, and the grain size number of the strip is graphically shown in FIG. 3. FIG. 3 is based on the experiments in which steel strips of C 0.06% and 0.15 mm in thickness having various grain size numbers were prepared by varying the rolling reduction and annealing temperature, and tested using a standard roller for a strip steel. As revealed from FIG. 3, the greater the grain size number, that is the finer the grains, the greater the number of passes required.

In the finish cold rolling step, the steel strip should be rolled with a rolling reduction of at least 10%, preferably at least 15%. If the rolling reduction is less than 10%, the number of nuclei for recrystallization formed in the course of the subsequent annealing step is unduly small, and depending upon the annealing conditions, no recrystallization occurs, or once it occurs, extremely coarse grains are formed. If the grains are coarser than those of a grain size number of 4, it is difficult to obtain a satisfactory product owing to the formation of coarse surface textures upon press-forming and to the lack of sufficient mechanical strength. Furthermore, coarse grains may be the cause of badly affecting the desired configuration of the inner walls of holes formed in the shadow mask. In general, plural grains should be present in the inner wall of one hole. If the grain size number is less than 4, grain boundaries of a monolithic single crystal might extend from one end of a hole to the other.

The annealing temperature should be at least 520° C., preferably at least 550° C. If the annealing temperature is substantially lower than 520° C., the recrystallization will not take place in the course of annealing. The annealing temperature should preferably be not higher than 750° C. The object of the invention is to reduce the usable annealing temperatures so as to avoid difficulties associated with high annealing temperatures.

For the growth of the desired grain an annealing time of at least 10 minutes will be required. In general, the lower the annealing temperature the longer the annealing time will be required. However, the growth of grains becomes saturated after a certain period of time depending upon the conditions, an excessively prolonged annealing time is not necessary. Normally, an annealing time of 10 to 30 minutes is practical.

The annealed flat mask is then caused to pass several times through a roller leveller in order to erase any waves formed in the mask in the annealing step and to prevent "stretcher strains" from arising in the subsequent press-forming step. This number of passes required is comparable to or even less than that required in the prior art high temperature anneal. The flat mask so levelled is then press-formed into the desired curved shape.

While the description has been made about a low carbon steel, it should be appreciated that the invention is applicable to decarburized steel materials, including for example a cold rolled steel strip from a cold rolled steel sheet of an intermediate thickness which sheet has been subjected to decarburization in the form of an open coil in an atmosphere of wet hydrogen, a cold rolled steel strip prepared from a hot rolled sheet from a steel which has been subjected to decarburization in the form of an open coil in an atmosphere of wet hydrogen, and a cold rolled steel strip prepared from a hot rolled steel sheet from a steel which has been decarburized by a vacuum degassing process. The use of such decarburized steel materials is advantageous in that the annealing time may be shortened because the decarburization has rendered the materials to be in such a state that grains may readily grow in the course of annealing for recrystallization. Any species of low carbon steel, including rimmed, capped and killed steels, may be used in the process of the invention.

EXAMPLE

Coils of hot rolled steel sheets having a thickness of 2.5 mm were produced from a molten rimmed steel (C, 0.06%; Mn, 0.30%; Si, 0.01%; P, 0.017%; S, 0.013%) prepared in a 90 ton LD converter. Shadow masks of a thickness of 0.15 mm were manufactured by the processing procedures as indicated in Table 2, second column, for Run Nos. 1 to 6 and 8. The open coil decarburization anneal indicated in Table 2 as "OCDA" was carried out in a wet hydrogen atmosphere (AX gas having a dew point of +50° C.). In Run No. 7, a coil of a hot rolled steel sheet having a thickness of 2.5 mm was prepared from an alumi-killed steel (C, 0.005%; Si, 0.03%; Mn, 0.29%; P, 0.017%; S, 0.012%) which had been decarburized by a vacuum degassing process.

The ferrite grain size number measured prior to the press-forming step, coercive force (Hc) measured prior to the press-forming step using the initial magnetizing field of 25 Oersted, press-formability and number of passes through a standard roller leveller required to avoid stretcher strains occurring in the press-forming step were shown in Table 2 together with the processing conditions.

As seen from the results shown in Table 2, the products obtained by the process in accordance with the invention, in which the recrystallization anneal is carried out at low temperatures, exhibit good electromagnetic property and processing performance comparable or even superior to those of the product obtained in Run No. 5 which is a prior art process using a high annealing temperature. If the finish cold rolling reduction is too high (Run No. 6), the product has a poor electromagnetic property as reflected by its high coercive force and requires a great number of passes through a roller leveller for avoiding stretcher strains. Whereas if the annealing temperature substantially exceeds 750° C. (Run No. 8), the press-formed product is faulty because of its coarse surface textures.

Furthermore, it will be understood that the desired satisfactory electromagnetic property and good processing performance can be achieved by the invention even with a steel of C 0.06% (Run Nos. 1 and 2). This is surprising from the teachings of Japanese Patent Publication No. 51-13102.

TABLE 2

| Run No. | Manufacturing Steps | C(%) | Finish cold rolling reduction | Anneal after etching | Grain size number | Coercive force (Oe) | Press-formability | Number of passes through leveller to avoid stretcher strains | Remarks |
|---|---|---|---|---|---|---|---|---|---|
| 1 | HOT(2.5mm)→CP→CR (0.2mm)→TCA(570° C. × 8Hr)→CR(0.15 mm)→E→anneal→Lv→Press | 0.06 | 25% | 590° C. × 10min. | 6.0 | 1.4 | Good | 5 | according to the invention |
| 2 | HOT(2.5mm)→CP→CR (0.18mm)→TCA(570° C. × 8Hr)→CR(0.15mm)→E→anneal→Lv→Press | 0.06 | 17% | 580° C. × 10min. | 5.0 | 1.2 | Good | 4 | according to the invention |
| 3 | HOT(2.5mm)→CP→CR (0.6mm)→OCDA(690° C. × 12Hr)→CR(0.2mm)→TCA(570° C. × 8Hr)→CR(0.15mm)→E→anneal→Lv→Press | 0.002 | 25% | 550° C. × 20min. | 4.0 | 1.1 | Good | 3 | according to the invention |
| 4 | HOT(2.5mm)→CP→OCDA (590° C. × 12Hr)→CR (0.2mm)→TCA(570° C. | 0.002 | 25% | 550° C. | 4.0 | 1.0 | Good | 3 | according |

TABLE 2-continued

| Run No. | Manufacturing Steps | C(%) | Finish cold rolling reduction | Anneal after etching | Grain size number | Coercive force (Oe) | Press-formability | Number of passes through leveller to avoid stretcher strains | Remarks |
|---|---|---|---|---|---|---|---|---|---|
| | × 8Hr)→CR→E→anneal →Lv→Press | | | × 10min. | | | | | to the invention |
| 5 | HOT(2.5mm)→CP→CR (0.3mm)→TCA(570° C. × 8Hr)→CR(0.15mm) →E→anneal→Lv→ Press | 0.05 | 50% | 890° C. × 2Hr | 6.0 | 1.4 | Good | 5 | prior art |
| 6 | HOT(2.5mm)→CP→CR (0.3mm)→TCA(570° C. × 8Hr)→CR(0.15mm)→ anneal→Lv→Press | 0.06 | 50% | 570° C. × 10min. | 10.0 | 4.5 | Good | 30 | rolling reduction is too high |
| 7 | Vacuum decarburization (HOT 2.5mm)→CP →CR(0.2mm)→TCA(570° C. × 8Hr→CR(0.15mm)→E→ anneal→Lv→Press | 0.005 | 25% | 530° C. × 10min. | 4.5 | 1.2 | Good | 3 | according to the invention |
| 8 | HOT(2.5mm)→CP→CR (0.2mm)→TCA(570° C. × 8Hr)→CR(0.15mm)→ E→anneal→Lv→Press | 0.06 | 25% | 860° C. × 10min. | 2.0 | 0.6 | Good (coarse surface textures) | 3 | annealing temperature is too high |

HOT... Hot rolled sheet
CP... cold pickling
CR... cold rolling
TCA... tight coil anneal
OCDA... open coil decarburization anneal
E... etching
Lv... leveller

What is claimed is:

1. A process for manufacturing a shadow mask of a Braun tube for a color TV, comprising the steps of subjecting a strip of low carbon steel to a cold rolling finish with a rolling reduction of 10 to 35% to provide a steel strip material of not more than 0.2 mm in thickness, forming predetermined patterns of holes in the material by a photo-etching technique, cutting the material into individual flat masks of a predetermined dimension, annealing each flat mask at a temperature of 520° to 750° C., conditioning the annealed mask by passing it through a roller leveller, and press-forming the conditioned flat mask into a desired shape.

2. A process in accordance with claim 1 wherein the starting steel strip contains 0.015 to 0.10% by weight of carbon.

3. A process in accordance with claim 1 wherein the finish cold rolling reduction is within the range between 15 and 35%.

* * * * *